US006166752A

United States Patent [19]

Izumi

[11] Patent Number: 6,166,752

[45] Date of Patent: Dec. 26, 2000

[54] APPARATUS AND METHOD FOR FORMING IMAGE BY CAUSING INK TO JUMP

[75] Inventor: Tomoo Izumi, Toyonaka, Japan

[73] Assignee: Minolta Co., Ltd., Osaka, Japan

[21] Appl. No.: 09/503,707

[22] Filed: Feb. 14, 2000

[30] Foreign Application Priority Data

Feb. 15, 1999 [JP] Japan ..... 11-035514

[51] Int. Cl.[7] ..... G03G 15/10

[52] U.S. Cl. ..... 347/141; 399/240; 430/117

[58] Field of Search ..... 399/237, 239, 399/240, 147; 430/117; 101/DIG. 37; 347/55, 112, 140, 141, 158; 427/466

[56] References Cited

U.S. PATENT DOCUMENTS

| | | | |
|---|---|---|---|
| 4,268,597 | 5/1981 | Klavan et al. | 430/117 X |
| 4,493,550 | 1/1985 | Takekida | 399/240 |
| 5,622,805 | 4/1997 | Uehara et al. | 430/117 |

FOREIGN PATENT DOCUMENTS

| | | |
|---|---|---|
| 56-104361 | 8/1981 | Japan . |
| 2-125276 | 5/1990 | Japan . |

*Primary Examiner*—Joan Pendegrass
*Attorney, Agent, or Firm*—McDermott, Will & Emery

[57] ABSTRACT

An image forming apparatus includes a latent image carrying member that carries an electrostatic latent image on a surface thereof, and an ink holding member that is disposed in opposing relation to the latent image carrying member and holds a thin layer of conductive ink on a surface thereof. The surface of the ink holding member is formed of a conductive material and has a plurality of projecting portions. The image forming apparatus further comprising a voltage applying unit that applies, to the projecting portions, a voltage of polarity different from that of a potential of the electrostatic latent image and thereby causes the ink to jump from the projecting portions located in opposing relation to the electrostatic latent image toward the electrostatic latent image. In the image forming apparatus, the following weak inequality is satisfied:

$$(h1+h2-h3)/(h1+h2) \geqq 0.1,$$

where h1 represents height of each of the projecting portions, h2 represents thickness of the thin layer of ink on each of the projecting portions, and h3 represents thickness of the thin layer of ink between the projecting portions.

18 Claims, 9 Drawing Sheets

① matrix pattern

② staggered pattern

APPARATUS AND METHOD FOR FORMING IMAGE BY CAUSING INK TO JUMP

This application is based on Japanese Patent Application No. Hei 11-35514 filed in Japan on Feb. 15, 1999, the entire content of which is hereby incorporated by reference.

BACKGROUND OF THE INVENTION

1. Field of the Invention

The present invention relates to an apparatus and method for forming an image and, more particularly, to an apparatus and method for forming an image by causing ink to jump from a thin layer of conductive ink held on an ink holding member in accordance with an electrostatic latent image on a latent image carrying member or with a recording voltage applied to a recording electrode and attaching the ink indirectly or directly to a recording medium.

2. Description of Related Art

There has conventionally been known an apparatus which forms an image by causing ink drops to jump, under a Coulomb's force, from a thin layer of conductive ink formed on an ink holding member to an electrostatic latent image on a latent image carrying member, developing the electrostatic latent image with the ink drops, and transferring an ink image formed by the development to a recording medium such as a sheet of paper.

In the image forming apparatus of this type, it is extremely important for the formation of a high-resolution image to reduce the size of an ink drop which jumps from the ink holding member toward the latent image carrying member and thereby reduce the diameter of a dot on the latent image carrying member and on the recording medium.

OBJECT AND SUMMARY

An object of the present invention is to provide an improved apparatus and method for forming an image whereby the foregoing problems are solved.

The foregoing object is attained by providing an image forming apparatus comprising:

a latent image carrying member for carrying an electrostatic latent image on a surface thereof;

an ink holding member disposed in opposing relation to the latent image carrying member and holding a thin layer of conductive ink on a surface thereof, the surface of the ink holding member being formed of a conductive material and having a plurality of projecting portions; and a voltage applying unit for applying, to the projecting portions, a voltage of polarity different from that of a potential of the electrostatic latent image and thereby causing the ink to jump from the projecting portions located in opposing relation to the electrostatic latent image toward the electrostatic latent image, wherein the following weak inequality is satisfied $$(h1+h2-h3)/(h1+h2)\geqq 0.1,$$

where h1 represents height of each of the projecting portions, h2 represents thickness of the thin layer of ink on each of the projecting portions, and h3 represents thickness of the thin layer of ink between the projecting portions.

The foregoing object is attained by further providing an image forming apparatus comprising:

an electrode unit having a plurality of electrodes to each of which a voltage is applied individually;

an ink holding member disposed in opposing relation to the electrode unit and holding a thin layer of conductive ink on a surface thereof, the surface of the ink holding member being formed of a conductive material and having a plurality of projecting portions; and a voltage applying unit for applying, to the projecting portions, a voltage of polarity different from that of the voltage applied to the electrodes and thereby causing the ink to jump from the projecting portions located in opposing relation to the electrodes to which the voltage is applied toward the electrodes to which the voltage is applied, wherein the following weak inequality is satisfied $$(h1+h2-h3)/(h1+h2)\geqq 0.1,$$

where h1 represents height of each of the projecting portions, h2 represents thickness of the thin layer of ink on each of the projecting portions, and h3 represents thickness of the thin layer of ink between the projecting portions.

The foregoing object is attained by further providing an image forming method comprising the steps of:

(1) selectively generating a potential depending on an image to be formed at a position opposed to an ink holding member, wherein a surface of the ink holding member is formed of a conductive material and has a plurality of projecting portions;

(2) forming, on the surface of the ink holding member, a thin layer of conductive ink such that the following weak inequality is satisfied, $$(h1+h2-h3)/(h1+h2)\geqq 0.1,$$

where h1 represents height of each of the projecting portions, h2 represents thickness of the thin layer of ink on each of the projecting portions, and h3 represents thickness of the thin layer of ink between the projecting portions; and (3) applying a voltage of polarity different from that of the potential generated in the step (1) to the projecting portions and thereby causing the ink to jump from the projecting portions located in opposing relation to a position at which the potential is generated to the position at which the potential is generated.

In each of the foregoing apparatus and method, the height of the projecting portion is preferably in the range of 10 $\mu$m to 100 $\mu$m.

In each of the foregoing apparatus and method, the plurality of projecting portions may be arranged as a matrix or in a staggered pattern on the surface of the ink holding member.

In each of the foregoing apparatus and method, the ink having a viscosity of 1000 cP or less and a surface tension of 50 dyne/cm or less is particularly preferred.

In the apparatus and method for forming an image according to the present invention, the voltage of polarity different from that of the potential of the electrostatic latent image or of the voltage applied to the electrode is applied to the projecting portions on the surface of the ink holding member. When the ink holding member is opposed to, e.g., the electrostatic latent image on the latent image carrying member in this state, charge of the polarity opposite to that of the potential of the latent image is induced collectively on the tip of each of the projecting portions by electrostatic induction, which is injected in the thin layer of conductive ink on each of the projecting portions. An electric field is formed between the thin layer of conductive ink and the electrostatic latent image due to the difference between the charge thus injected in the thin layer of conductive ink and the charge of the electrostatic latent image. By the action of the electric field, a Coulomb's force directed toward the electrostatic latent image is exerted on the ink on the periphery of each of the projecting portions. This causes the ink to swell up on the projecting portion and form a meniscus.

When the meniscus is formed, if the thin layer of ink is formed to satisfy the conditional inequality $(h1+h2-h3)/(h1+h2) \geqq 0.1$, a relatively small meniscus is formed on the projecting portion. When the injected charge converges on the tip of the small meniscus and the Coulomb's force exerted on the tip thereof is further increased, a small ink drop is separated from the tip of the small meniscus to jump. The jumped ink drop is temporarily attached to the electrostatic latent image to form an ink image and then transferred onto a recording medium to form an image or, alternatively, the jumped ink drop is attached directly to the recording medium to form an image.

Thus, in the apparatus and method for forming an image according to the present invention, the meniscus is formed on the thin layer of ink on each of the projecting portions opposed to the electrostatic latent image or to the electrode to which the voltage is applied. Accordingly, the ink is more likely to jump even if the electric field is not so intense. Since stable jumping of the ink is performed even when the potential of the electrostatic latent image or the voltage applied to the electrode is reduced, a driving circuit system as well as a power supply unit for charging the latent image carrying member or applying a voltage can be scaled down, simplified, and power-saved, which leads to lower cost.

Since the apparatus and method for forming an image according to the present invention has formed the thin layer of ink to satisfy the foregoing conditional inequality, a relatively small meniscus can be formed on the projecting portion of the ink holding member. Accordingly, a small ink drop is allowed to jump from the meniscus. This reduces the size of a dot formed on the latent image carrying member or on the recording medium and increases the resolution of an image.

BRIEF DESCRIPTION OF THE DRAWINGS

These and other objects and features of the present invention will become clear from the following description taken in conjunction with the preferred embodiments thereof with reference to the accompanying drawings, in which:

FIG. 5(*b*) is an enlarged cross-sectional view of the portion D of FIG. 2;

FIG. 7(*b*) is a view showing the process in which a meniscus is formed on the projecting portion and the ink jumps when the thin layer of ink is formed not to satisfy the conditional inequality of the present invention;

DETAILED DESCRIPTION OF THE PREFERRED EMBODIMENTS

Referring now to the accompanying drawings, preferred embodiments of the present invention will be described.

Figure 1:
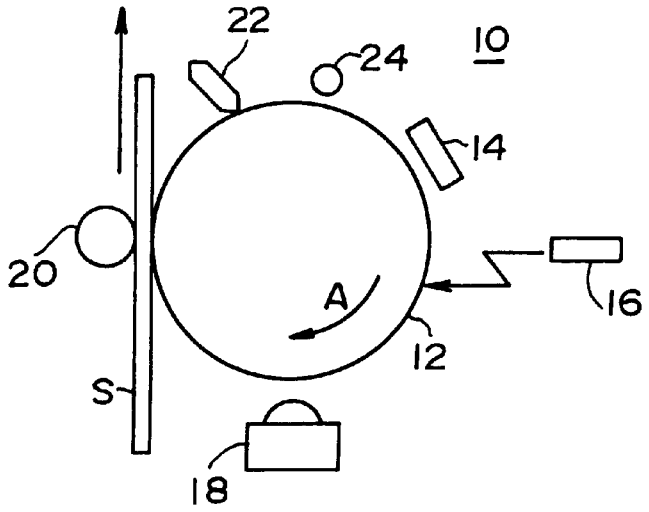
FIG. 1 is a view showing a schematic structure of an image forming apparatus as an embodiment of the present invention.

FIG. 1 is a schematic structural view of an image forming apparatus 10 as an embodiment of the present invention. The image forming apparatus 10 comprises a photosensitive drum 12 as a latent image carrying member. The photosensitive drum 12 is so constituted as to be rotatively driven in the direction indicated by the arrow A. Around the photosensitive drum 12, there are: a corona charging unit 14 for uniformly charging a surface of the photosensitive drum 12; an exposing unit 16 for forming an electrostatic latent image by exposing the surface of the photosensitive drum 12 charged uniformly to remove the charge of the exposed portion and leave the charge of the unexposed portion; an ink developing unit 18 for developing the formed electrostatic latent image with conductive ink; a transfer roller 20 for transferring the developed ink image onto a sheet S as a recording medium; a cleaning unit 22 for recovering the ink remaining on the surface of the photosensitive drum 12 after transfer; and a destaticizing unit 24 for erasing the electrostatic latent image, which are disposed successively in the direction of rotation of the photosensitive drum 12.

A method of forming an electrostatic latent image is not limited to the foregoing exposing method. Another method such as an ion flow method, a pyroelectric method, or a method of polarizing a ferroelectric material with heat or electricity may also be used to form the electrostatic latent image. It is also possible to form a large number of microelectrodes over the entire surface of the drum. These techniques are well known. Optionally, an ink fixing unit for drying and fixing the ink image transferred onto the sheet S may also be provided, though it is not shown in the drawing.

Figure 2:
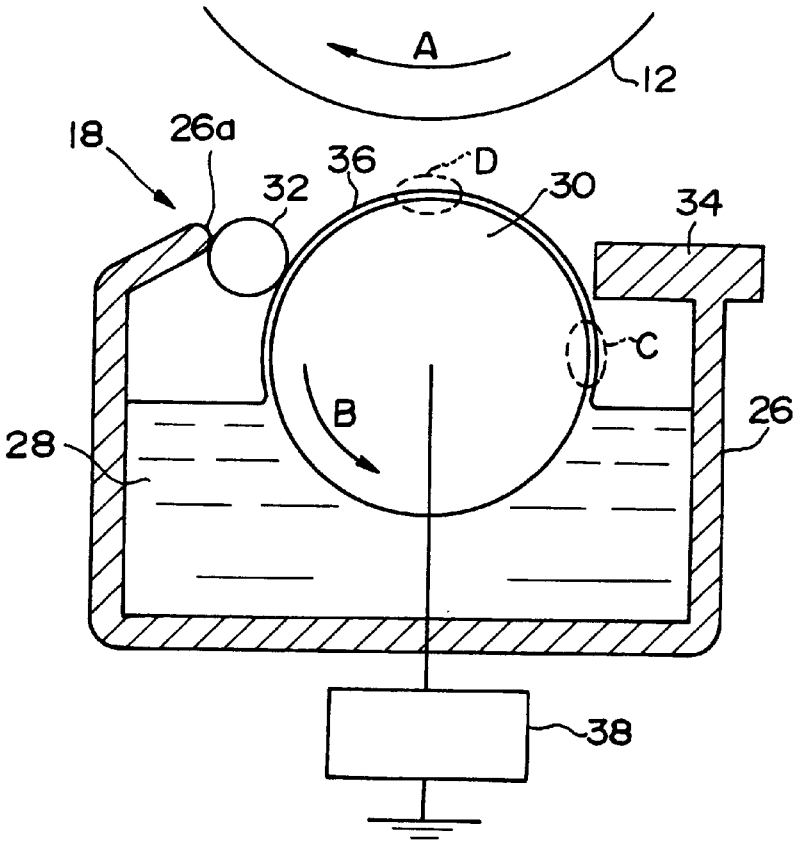
FIG. 2 is a view showing in detail an ink developing unit.
Figure 3A:
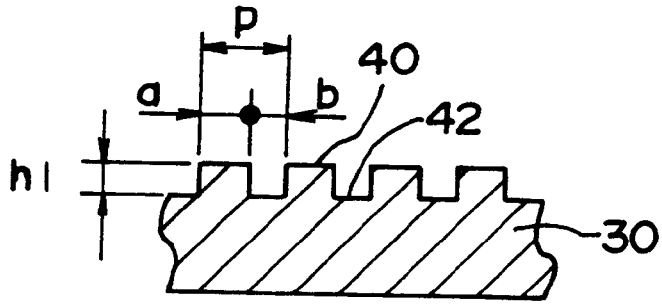
FIGS. 3(*a*) to 3(*d*) are partially enlarged cross-sectional views of projecting portions on a surface of an ink holding roller.
Figure 3B:
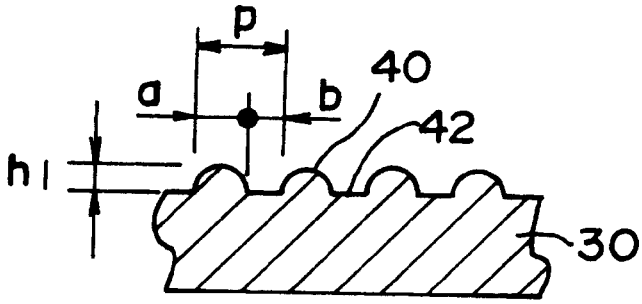
Figure 3C:
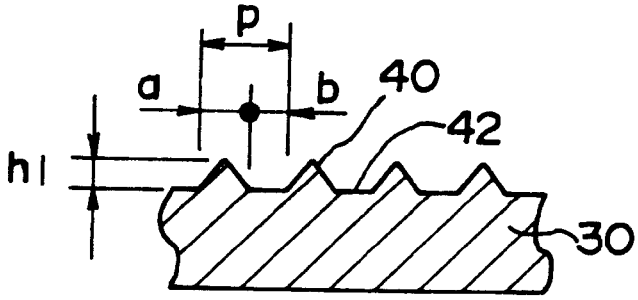
Figure 3D:
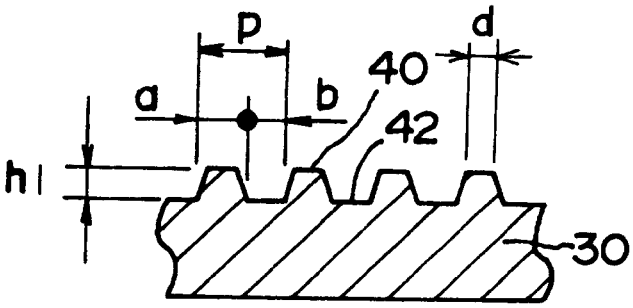

As shown in FIG. 2, the ink developing unit 18 includes a casing 26 having an opening opposed to the photosensitive drum 12. Conductive ink 28 is contained within the casing 26. The ink holding roller 30 as an ink holding member is disposed in the opening of the casing 26 to be rotatively driven in the direction indicated by the arrow B. A seal roller 32 is disposed between an upper edge portion 26*a* of the casing 26 and the ink holding roller 30 to prevent the leakage and drying of the ink. If necessary, an ink-thin-layer stabilizing blade 34 may also be provided at the upper edge portion of the casing 26 opposite to the seal roller 32 relative to the ink holding roller 30.

The ink holding roller 30 has at least a surface layer portion formed of a conductive material. The surface of the ink holding roller 30 is formed with a large number of extremely small projecting portions 40 (see FIGS. 3(*a*) to 3(*d*) and FIGS. 4(*a*) and 4(*b*)). The projecting portions 40 may be formed by processing the surface of a metal roller by cutting, etching, or electric casting or by forming a resin roller with projecting portions and then covering the entire surface of the roller with a metal thin film by sputtering or the like. The ink holding roller 30 is electrically connected to an offset power supply 38, whereby a specified voltage of polarity different from that of the potential of the latent image, e.g., positive polarity is applied to each of the projecting portions 40 on the ink holding roller 30. The ink holding roller 30 may also be grounded directly such that the ground voltage is used as the specified voltage.

In FIG. 3(*a*) is shown a partially enlarged cross-sectional view of the surface of the ink holding roller 30 when it is axially cut. Since each of the projecting portions 40 is configured as a cylinder or a rectangular parallelepiped, it has a rectangular cross section. The projecting portions 40 are arranged with an equal pitch p to form a matrix over the entire surface of the ink holding roller 30 (see FIG. 4(*a*)). The pitch p of the projecting portions 40 is preferably in the range of 20 to 100 $\mu$m. This is because, if the pitch p is smaller than 20 $\mu$m, an ink thin layer with a rough surface which satisfies a conditional inequality described later becomes less likely to be formed and, if the pitch p is larger than 100 $\mu$m, a jumping ink drop increases in size and reduces resolution. The ratio of the width a of each of the projecting portions 40 to the width b of each of depressed portions 42 (portions between the projecting portions) need not necessarily be 1:1 provided that it is in the range of a:b=7:3 to 3:7. This is because, if the proportion of the width a of the projecting portion 40 is under the foregoing range, manufacturing becomes difficult and, if the proportion of the width a of the projecting portion 40 is over the foregoing range, resolution is reduced. The height h1 of each of the projecting portions 40 is preferably in the range of 10 to 100 $\mu$m. This is because, if the height h1 is smaller than 10 $\mu$m, an ink thin layer with a rough surface which satisfies the conditional inequality described later becomes less likely to be formed and, if the height h1 is larger than 100 $\mu$m, manufacturing becomes difficult.

Figure 4A:
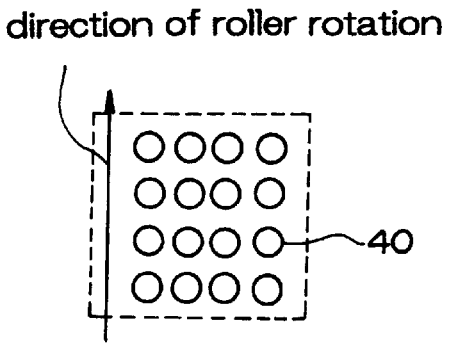
FIGS. 4(*a*) and 4(*b*) are partially enlarged plan views showing respective arrangement patterns for the projecting portions on the ink holding roller.
Figure 4B:
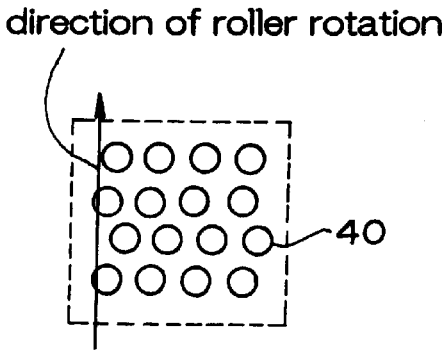

The configuration of the projecting portion 40 is not limited to a cylinder or a rectangular parallelepiped. It may have another configuration such as a hemispherical configuration with a generally semicircular cross section, as shown in FIG. 3(*b*). It may have a conical or pyramidal configuration with a triangular cross section, as shown in FIG. 3(*c*). It may have a truncated conical or truncated pyramidal configuration with a trapezoidal cross section, as shown in FIG. 3(*d*). If the cross section of the projecting portion 40 is trapezoidal as shown in FIG. 3(*d*), the width d of the upper side thereof is preferably in the range of 2 to 30 $\mu$m. If the cross section of the projecting portion 40 is rectangular, triangular, trapezoidal, or the like, the end face or side face of the projecting portion 40 may be curved. Although the projecting portions 40 have been arranged to form a matrix on the surface of the ink holding roller 30, as shown in FIG. 4(*a*), they may also be arranged in a staggered pattern, as shown in FIG. 4(*b*), or may be arranged in a given pattern other than the foregoing.

Next, a description will be given to the operation of the image forming apparatus 10 thus constituted. In the ink developing unit 18, the ink holding roller 30 is rotatively driven in the direction indicated by the arrow B, while having the lower portion thereof immersed in the ink 28. As a result, the ink 28 is applied to the surface of the ink holding roller 30 to form the ink thin layer 36.

Figure 5A:
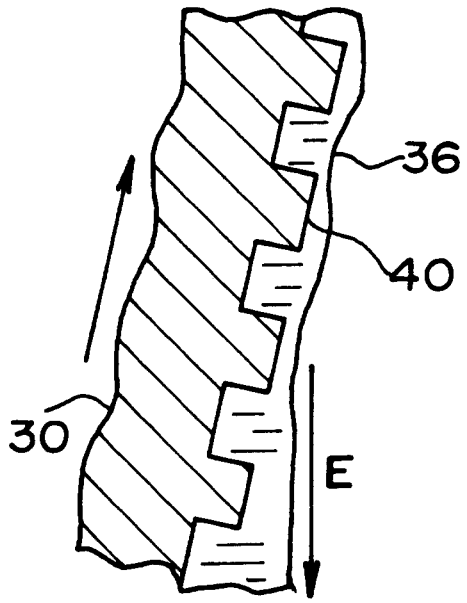
FIG. 5(*a*) is an enlarged cross-sectional view of the portion C of FIG. 2.
Figure 5B:
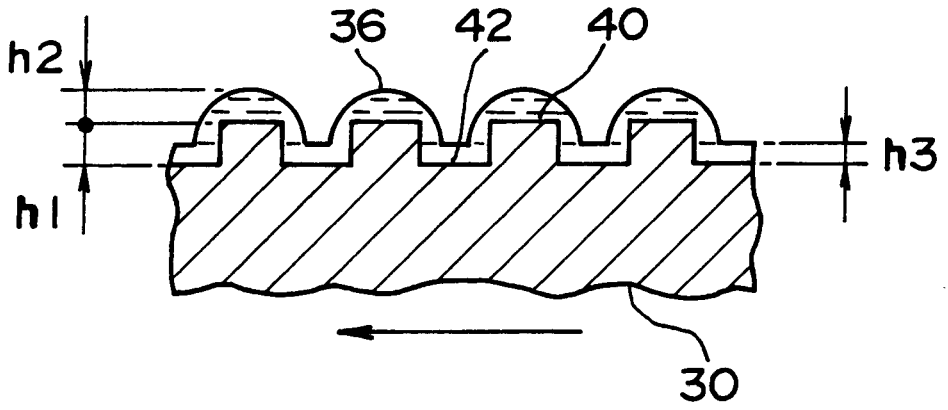

If the ink 28 with a low viscosity is used, extra ink falls by gravitation in the direction indicated by the arrow E along the surface of the ink holding roller 30 adjacent the liquid level of the ink 28 and returns to an ink reservoir, as shown in FIG. 5(*a*) which is an enlarged view of the portion C of FIG. 2.

On the other hand, the ink thin layer 36 has been formed on the surface of the ink holding roller 30 opposed to the photosensitive drum 12, as shown in FIG. 5(*b*). The ink thin layer 36 has been formed to satisfy the conditional inequality $(h1+h2-h3)/(h1+h2) \geqq 0.1$ if the height of each of the projecting portions 40 is hl, the thickness of the ink layer on each of the projecting portions 40 is h2, and the thickness of the ink layer between the projecting portions 40, i.e., in each of the depressed portions 42 is h3. In the case where the conditional inequality is satisfied, the ink thin layer 36 is formed to have a surface swelling up in conformity with the projecting portions 40 and being dented to a certain depth (e.g., several micrometers) or more in conformity with the depressed portions 42. To the contrary, if the ink thin layer 36 is formed to have a flat, smooth surface covering each of the projecting portions 40, the conditional inequality is not satisfied.

To form the foregoing ink thin layer 36 with the rough surface, the ink viscosity is preferably 1000 cP or less. If the ink viscosity is higher than 1000 cP, the fluidity of the ink is lowered and the rough surface in conformity with the projecting portions 40 and the depressed portions 42 becomes less likely to be formed. The surface tension of the ink is preferably 50 dyne/cm or less. If the surface tension of the ink is higher than 50 dyne/cm, the ink on the projecting portions 40 is separated from the ink within the depressed portions 42 so that the ink thin layer 36 with the rough surface covering the projecting portions 40 and depressed portions 42 without a break becomes less likely to be formed.

Figure 6:
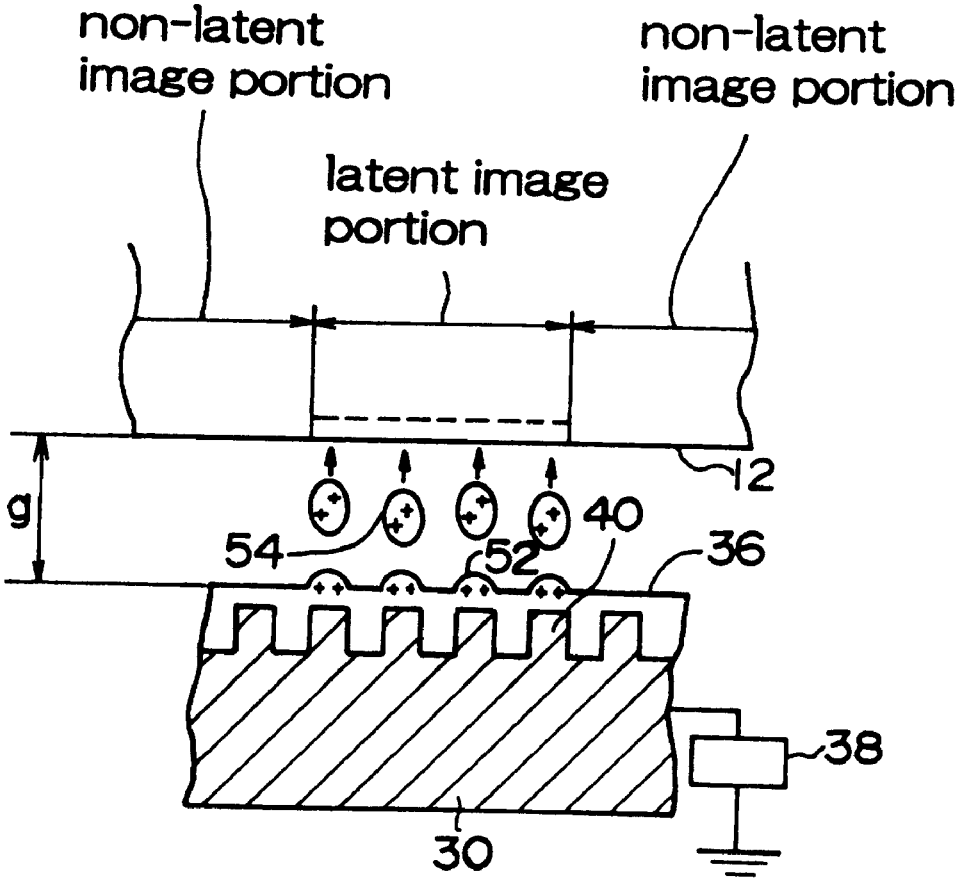
FIG. 6 is a view for illustrating the principle of ink jumping from the positions corresponding to the projecting portions on the ink holding roller.

As shown in FIG. 6, a specified positive voltage is applied from the offset power supply 38 to each of the projecting portions 40 on the ink holding roller 30. In this condition, when each of the projecting portions 40 covered with the ink thin layer 36 is opposed to an electrostatic latent image portion on the photosensitive drum 12, charge of polarity opposite to that of the potential of the latent image, e.g., positive charge is induced on the tip of each of the projecting portions 40 at positions opposed to the latent image by electrostatic induction and injected into the ink thin layer 36 on each of the projecting portions 40. An electric field is formed between the conductive ink thin layer 36 and the photosensitive drum 12 due to the difference between the positive charge injected into the conductive ink thin layer 36 and the negative charge of the electrostatic latent image on the photosensitive drum 12. By the action of the electric field, a Coulomb's force directed toward the electrostatic latent image portion is exerted on the ink on each of the projecting portions 40, whereby the ink on the projecting portion 40 swells up to form a meniscus 52.

Figure 7A:
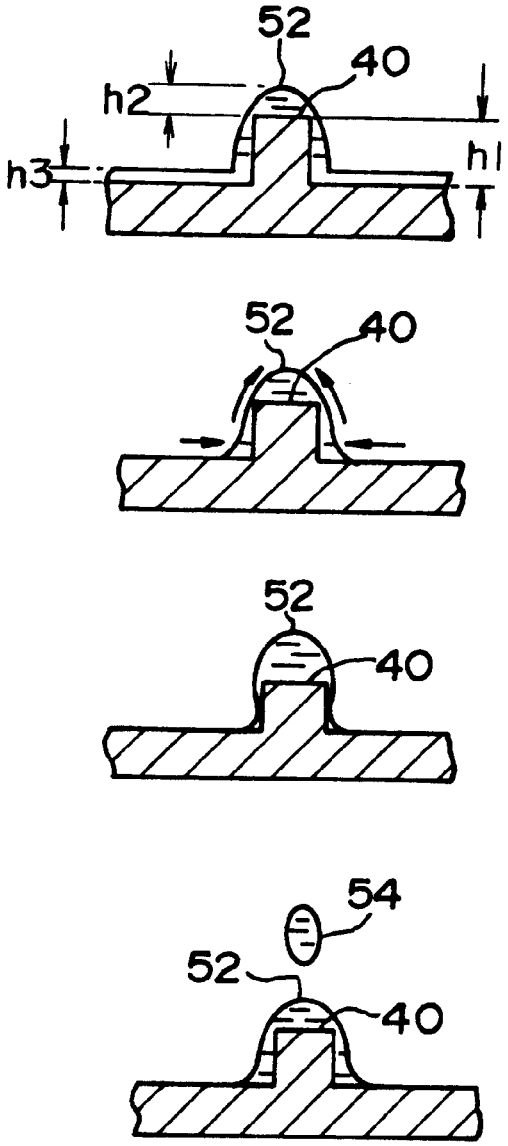
FIG. 7(*a*) is a view showing the process in which a meniscus is formed on the projecting portion and the ink jumps when the thin layer of ink is formed to satisfy the conditional inequality of the present invention.
Figure 7B:
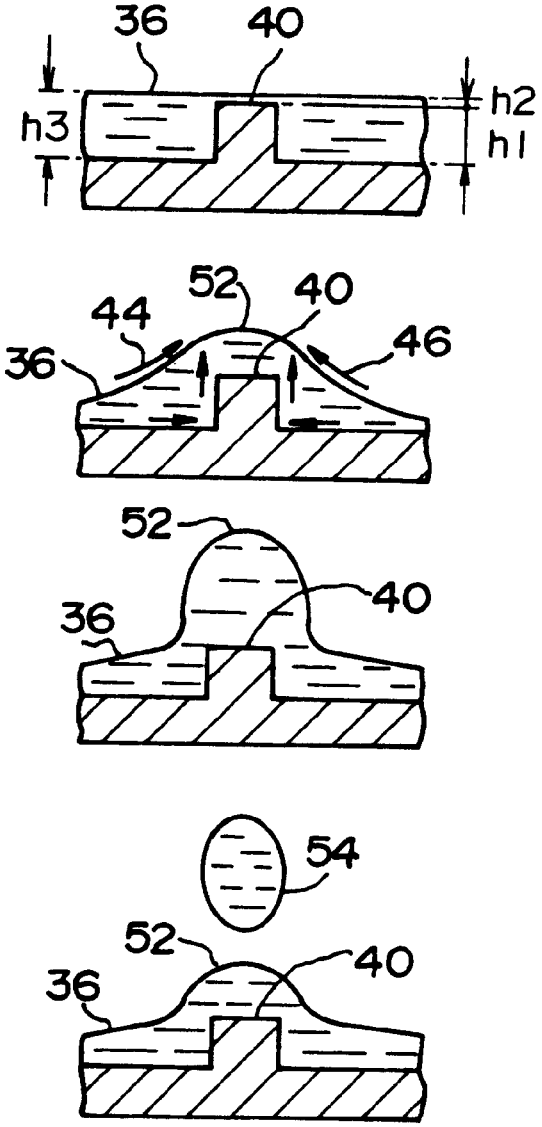

In thus forming the meniscus 52, if the ink thin layer 36 has a flat, smooth surface, i.e., if the foregoing conditional inequality is not satisfied as shown in FIG. 7(*b*), the ink on the periphery of the projecting portion 40 not only moves along the projecting portion 40 but also moves to swell up on the projecting portion 40 in the directions indicated by the arrows 44, 46 at the surface layer portion of the ink thin layer 36. As a result, a relatively large meniscus 52 is formed on the projecting portion 40. Since the larger meniscus 52 has a tip closer to the photosensitive drum 12, a larger Coulomb's force is exerted on the tip so that a relatively large ink drop 54 is separated to jump. By contrast, since the ink thin layer 36 of the present embodiment has been formed to have a rough surface by reducing the thickness of the ink in the depressed portions 42 such that the foregoing conditional inequality is satisfied, as shown in FIG. 7(*a*), the ink on the periphery of the projecting portion 40 is allowed only to move along the projecting portion 40 as indicated by the arrow in the drawing and the meniscus 52 formed on the projecting portion 40 is relatively small. Accordingly, the tip of the smaller meniscus 52 is at a distance from the photosensitive drum 12, i.e., at a position receiving a weak Coulomb's force. As a result, a small ink drop 54 is separated from the small meniscus 52 to jump.

The ink drop 54 that has jumped from the meniscus 52 is attached to and develops the electrostatic latent image, whereby an ink image is formed on the photosensitive drum 12. Thereafter, the ink image is transferred onto the sheet S to form an image. Thus, in the image forming apparatus 10 of the present embodiment, the ink drop that has jumped from the ink holding roller 30 is temporarily attached to the electrostatic latent image on the photosensitive drum 12 to form the ink image, which is then transferred onto the sheet S. In short, the ink drop from the ink holding roller 30 is attached indirectly to the sheet S to form an image.

As described above, the image forming apparatus 10 of the present embodiment forms the meniscus 52 at the ink thin layer 36 on each of the projecting portions 40 opposed to the electrostatic latent image, so that the ink is more likely to jump even if the electric field is not so intense. This allows stable jumping of the ink even when the potential of the electrostatic latent image is lowered, while downscaling, simplifying, and power-saving the power supply and driving circuit system for the charging unit 14 for charging the photosensitive drum 12, leading to lower cost.

Since the ink thin layer has been formed to satisfy the conditional inequality in the image forming apparatus 10, the relatively small meniscus 52 can be formed on the projecting portion 40 of the ink holding roller 30 and the small ink drop 54 is allowed to jump from the meniscus 52. This reduces the size of the dot formed on the photosensitive drum 12 or on the sheet S and increases the resolution of an image.

Here, an experiment on the jumping of the ink was conducted by using the image forming apparatus 10 of the present embodiment under the following conditions. As the photosensitive drum 12, an OPC photosensitive drum was used. The charge potential on the photosensitive drum 12 (i.e., the potential of the electrostatic latent image) was set to −300 V and the developing speed (i.e., the peripheral speed of the photosensitive drum) was set to 200 mm/sec. The diameter and peripheral speed of the ink holding roller 30 were set to 100 mm and 200 mm/sec, respectively. The pitch p of the projecting portions 40 on the ink holding roller 30 was set to 50 $\mu$m. The ratio a:b of the respective widths of the projecting portion 40 and the depressed portion 42 was set to 1:1. The height h1 of the projecting portion 40 was set to 20 $\mu$m. The ink thin layer 36 was formed such that the thickness h2 of the ink on the projecting portion 40 was 10 $\mu$m and the thickness h3 of the ink in the depressed portion 42 between the projecting portions 40 is 15 $\mu$m. In this case, the value on the left side of the conditional inequality becomes $(h1+h2-h3)/(h1+h2)=(20+10-15)/(20+10)=0.5$, which satisfies the conditional inequality. To each of the projecting portions 40, a voltage of 1.5 kv was applied from the offset power supply 38. The development gap g (See FIG. 6) was set to 500 $\mu$m. The conductive ink used contains 10 wt % of any one of carbon black (black), chromophthal yellow (yellow), quinacridone magenta (magenta), and copper phthalocyanine blue (cyan), 86.99 wt % of water as a solvent, 0.01 wt % of a fluorine surface active agent as a surface active agent, 2 wt % of polyethylene glycol as a viscosity modifier, 1 wt % of styrene acrylate as a dispersant. The experiment was conducted under these conditions, with the result that the ink jumped excellently toward the electrostatic latent image. The diameter of the dot formed with the jumped ink was 30 to 35 $\mu$m.

By contrast, a control experiment was performed under the same conditions as the foregoing experiment, except that the thickness h2 of the ink in the depressed portion 42 between the projecting portions 40 was adjusted to 30 $\mu$m. In this case, the ink thin layer 36 had a flat, smooth surface so that the value on the left side of the conditional inequality was 0 and did not satisfy the conditional inequality. As a result, a crosstalk phenomenon which is mutual interference caused between the adjacent projecting portion 40 upon the jumping of the ink frequently occurred in the control experiment and the diameter of the dot formed with the jumped ink was approximately 50 $\mu$m or larger. Thus, the image forming apparatus 10 of the present embodiment allows stable jumping of the ink, formation of a small dot, and achievement of higher resolution.

Figure 8:
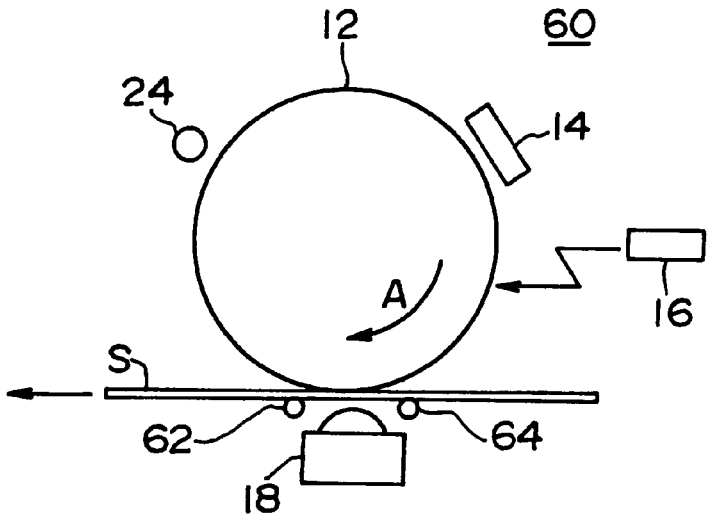
FIG. 8 is a view showing a schematic structure of an image forming apparatus according to another embodiment of the present invention.
Figure 9:
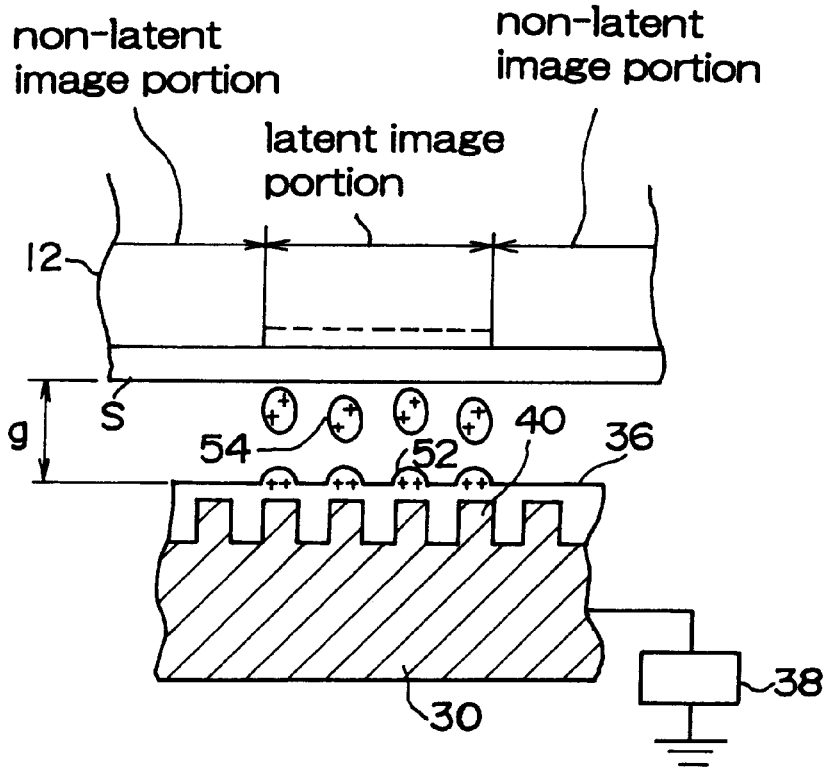
FIG. 9 is a view showing the ink jumped from the positions corresponding to the projecting portions on the ink holding roller and attached directly to a sheet of paper.

Next, an image forming apparatus 60 as another embodiment of the present invention will be described with reference to FIGS. 8 and 9. In contrast to the foregoing image forming apparatus 10 which has formed an image by attaching the ink drops jumped from the ink holding roller 30 indirectly to the sheet S, the image forming apparatus 60 of the present embodiment forms an image by attaching the ink drops jumped from the ink holding roller 30 directly to the sheet S. Accordingly, the image forming apparatus 60 has been adapted to transport the sheet S between the photosensitive drum 12 and the ink developing unit 18 disposed in opposing relation to each other, while keeping the sheet S in contact with the photosensitive drum 12. As for the other components, they are substantially the same as in the foregoing image forming apparatus 10 except that the provision of the cleaning unit 22 can be omitted since the ink is prevented from being attached to the photosensitive drum 12. If necessary, a pair of adhesion rollers 62, 64 may also be provided to increase adhesion of the sheet S to the photosensitive drum 12.

The principle of ink jumping in the image forming apparatus 60 is the same as described above with reference to FIGS. 6 and 7. As shown in FIG. 9, ink drops 54 jump from the positions corresponding to the projecting portions 40 on the ink holding roller 30 toward the latent image portion of the photosensitive drum 12 to be attached directly to the sheet S, thereby forming an image. The image forming apparatus 60 of the present embodiment can also achieve the same effects as achieved by the image forming apparatus 10.

Figure 10:
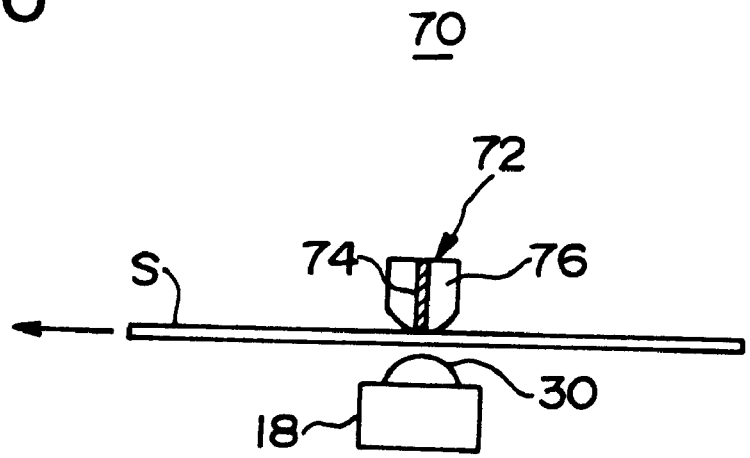
FIG. 10 is a view showing a schematic structure of an image forming apparatus according to still another embodiment of the present invention.
Figure 11:
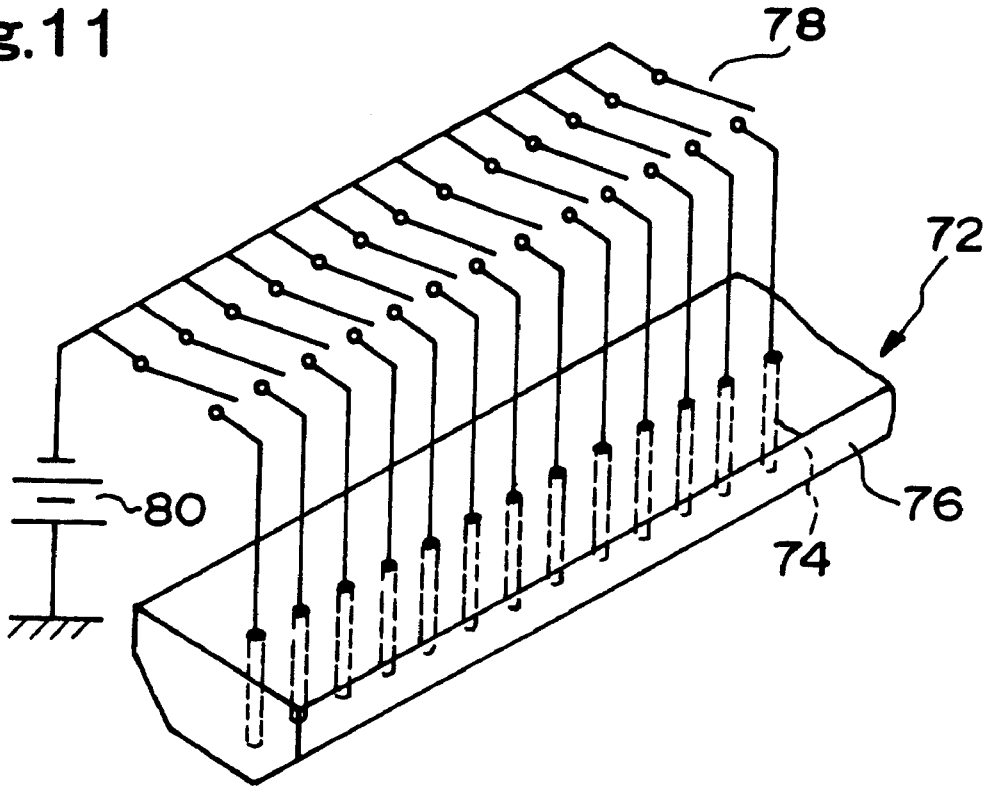
FIG. 11 is a partially enlarged view of a recording electrode.

Next, an image forming apparatus 70 as still another embodiment of the present invention will be described with reference to FIGS. 10 and 11. In the image forming apparatus 70, a recording electrode 72 is disposed in opposing relation to the ink holding roller 30 of the ink developing unit 18 with intervention of the sheet S. The sheet S is transported in the direction indicated by the arrow, while keeping contact with the lower portion of the recording electrode 72. As shown in FIG. 11, the recording electrode 72 is composed of a large number of discrete electrodes 74 regularly spaced in a direction orthogonal to the direction of sheet transportation and a protective insulating portion 76 covering the periphery of each of the discrete electrodes 74. The discrete electrodes 74 are arranged with a density corresponding to the pixel density of an image and have respective tip portions in contact with the sheet S. The discrete electrodes 74 are connected to a power supply 80 via individual switches 78. Each of the switches 78 is selectively turned ON based on image data to apply a recording voltage of negative polarity to the discrete electrodes 74 corresponding to the position to which the ink should be caused to jump and attached. Although FIG. 11 shows an exemplary structure of the recording electrode 72, the recording electrode 72 is not limited to the embodiment and a multistylus electrode in another embodiment may also be used.

The principle of ink jumping in the image forming apparatus 70 is the same as in the case of the image forming apparatus 60, except that the photosensitive drum 12 has been replaced by the recording electrode 72 and the latent image portion having negative charge has been replaced by the discrete electrode 74 to which the recording voltage of negative polarity is applied. When the recording voltage is applied to the discrete electrode 74, an ink drop jumps from the position corresponding to the projecting portion 40 of the ink holding roller 30 opposed thereto, so that the ink drop is applied directly to the sheet S to form an image. Since the image-forming apparatus 70 of the present embodiment also uses the ink developing unit 18, the same effects as achieved by the image forming apparatus 10 can be achieved.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

Figure 12:
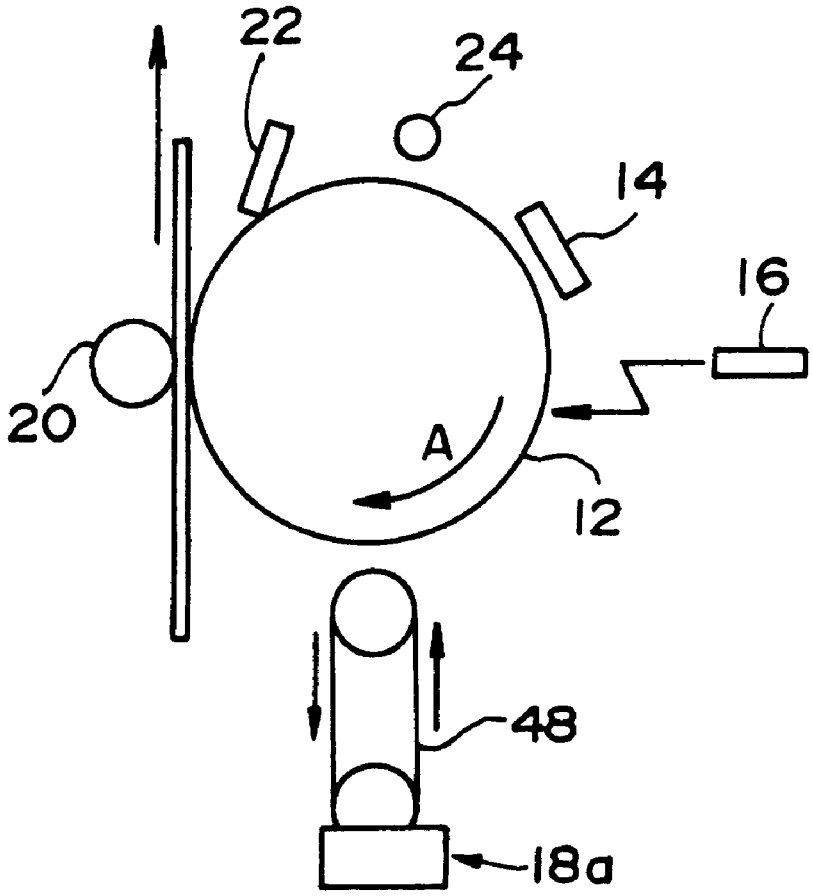
FIG. 12 is a view showing a schematic structure of an image forming apparatus using a belt as an ink holding member.

For example, although each of the image forming apparatus 10, 60, and 70 described above has used the roller 30 as the ink holding member, an ink holding belt 48 having a surface configuration similar to that of the ink holding roller 30 may be used instead in the ink developing unit 18*a*, as shown in FIG. 12.

Although the polarity of the electrostatic latent image or recording voltage has been negative in the foregoing description, the present invention is also applicable to the case where the polarity of the electrostatic latent image or recording voltage is positive.

What is claimed is:

1. An image forming apparatus comprising:

a latent image carrying member for carrying an electrostatic latent image on a surface thereof;

an ink holding member disposed in opposing relation to the latent image carrying member and holding a thin layer of conductive ink on a surface thereof, the surface of the ink holding member being formed of a conductive material and having a plurality of projecting portions; and a voltage applying unit for applying, to the projecting portions, a voltage of polarity different from that of a potential of the electrostatic latent image and thereby causing the ink to jump from the projecting portions located in opposing relation to the electrostatic latent image toward the electrostatic latent image, wherein the following weak inequality is satisfied:

$$(h1+h2-h3)/(h1+h2) \geqq 0.1,$$

where h1 represents height of each of the projecting portions, h2 represents thickness of the thin layer of ink on each of the projecting portions, and h3 represents thickness of the thin layer of ink between the projecting portions.

2. An image forming apparatus as claimed in claim 1, wherein the height of each of the projecting portions is in the range of 10 $\mu$m to 100 $\mu$m.

3. An image forming apparatus as claimed in claim 1, wherein the plurality of projecting portions are arranged as a matrix on the surface of the ink holding member.

4. An image forming apparatus as claimed in claim 1, wherein the plurality of projecting portions are arranged in a staggered pattern on the surface of the ink holding member.

5. An image forming apparatus as claimed in claim 1, wherein the ink has a viscosity of 1000 cP or less.

6. An image forming apparatus as claimed in claim 1, wherein the ink has a surface tension of 50 dyne/cm or less.

7. An image forming apparatus comprising:

an electrode unit having a plurality of electrodes to each of which a voltage is applied individually;

an ink holding member disposed in opposing relation to the electrode unit and holding a thin layer of conductive ink on a surface thereof, the surface of the ink holding member being formed of a conductive material and having a plurality of projecting portions; and a voltage applying unit for applying, to the projecting portions, a voltage of polarity different from that of the voltage applied to the electrodes and thereby causing the ink to jump from the projecting portions located in opposing relation to the electrodes to which the voltage is applied toward the electrodes to which the voltage is applied, wherein the following weak inequality is satisfied:

$$(h1+h2-h3)/(h1+h2) \geqq 0.1,$$

where h1 represents height of each of the projecting portions, h2 represents thickness of the thin layer of ink on each of the projecting portions, and h3 represents thickness of the thin layer of ink between the projecting portions.

8. An image forming apparatus as claimed in claim 7, wherein the height of each of the projecting portions is in the range of 10 $\mu$m to 100 $\mu$m.

9. An image forming apparatus as claimed in claim 7, wherein the plurality of projecting portions are arranged as a matrix on the surface of the ink holding member.

10. An image forming apparatus as claimed in claim 7, wherein the plurality of projecting portions are arranged in a staggered pattern on the surface of the ink holding member.

11. An image forming apparatus as claimed in claim 7, wherein the ink has a viscosity of 1000 cP or less.

12. An image forming apparatus as claimed in claim 7, wherein the ink has a surface tension of 50 dyne/cm or less.

13. An image forming method comprising the steps of:

(1) selectively generating a potential depending on an image to be formed at a position opposed to an ink holding member, wherein a surface of the ink holding member is formed of a conductive material and has a plurality of projecting portions;

(2) forming, on the surface of the ink holding member, a thin layer of conductive ink such that the following weak inequality is satisfied:

$$(h1+h2-h3)/(h1+h2) \geqq 0.1,$$

where h1 represents height of each of the projecting portions, h2 represents thickness of the thin layer of ink on each of the projecting portions, and h3 represents thickness of the thin layer of ink between the projecting portions; and (3) applying a voltage of polarity different from that of the potential generated in the step (1) to the projecting portions and thereby causing the ink to jump from the projecting portions located in opposing relation to a position at which the potential is generated to the position at which the potential is generated.

14. An image forming method as claimed in claim 13, wherein the height of each of the projecting portions is in the range of 10 $\mu$m to 100 $\mu$m.

15. An image forming method as claimed in claim 13, wherein the plurality of projecting portions are arranged as a matrix on the surface of the ink holding member.

16. An image forming method as claimed in claim 13, wherein the plurality of projecting portions are arranged in a staggered pattern on the surface of the ink holding member.

17. An image forming method as claimed in claim 13, wherein the ink has a viscosity of 1000 cP or less.

18. An image forming method as claimed in claim 13, wherein the ink has a surface tension of 50 dyne/cm or less.

* * * * *